US008926134B2

(12) United States Patent
Hast et al.

(10) Patent No.: US 8,926,134 B2
(45) Date of Patent: Jan. 6, 2015

(54) LIGHTING MODULE FOR MOUNTING ONTO A RAIL HAVING AN ELECTRICAL CONTACT

(75) Inventors: Michael Hast, Munich (DE); Lorenzo Roberto Trevisanello, Abano Terme (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/567,871

(22) Filed: Aug. 6, 2012

(65) Prior Publication Data

US 2013/0058091 A1 Mar. 7, 2013

(30) Foreign Application Priority Data

Aug. 4, 2011 (IT) ..... TO2011A0727

(51) Int. Cl.
*F21S 4/00* (2006.01)
*F21V 21/00* (2006.01)

(52) U.S. Cl.
USPC ..... 362/249.03; 362/249.01; 362/249.02; 362/227

(58) Field of Classification Search
None
See application file for complete search history.

(56) References Cited

U.S. PATENT DOCUMENTS

2007/0285949 A1 12/2007 Lodhie et al.

FOREIGN PATENT DOCUMENTS

DE 10 2008 017 614 9/2009
EP 1 733 653 12/2006

*Primary Examiner* — Natalie Walford
(74) *Attorney, Agent, or Firm* — Cozen O'Connor

(57) ABSTRACT

Lighting module mounted onto a C-shaped rail having a bottom wall and electrical lines extending along the rail includes a light source board having a first face carrying one or more light radiation sources and a second face carrying electrical contacts. A channel-shaped housing envelops the board and has a web wall for emitting the light radiation and two opposed side walls each facing one of the longitudinal edges of the board. Each of a pair of opposed guide members extends along one of the longitudinal edges of the board facing a corresponding side wall of the housing. Each of the guide members and the corresponding side wall of the housing have complementary, mutually cooperating, ramp-like surfaces to retain the light source board within the housing. Elastic members urge the board away from the web wall of the housing, whereby the complementary ramp-like surfaces are elastically urged against each other.

9 Claims, 5 Drawing Sheets

LIGHTING MODULE FOR MOUNTING ONTO A RAIL HAVING AN ELECTRICAL CONTACT

RELATED APPLICATIONS

This application claims the priority of Italian application no. TO2011A000727 filed Aug. 4, 2011, the entire content of which is hereby incorporated by reference.

FIELD OF THE INVENTION

The description relates to lighting modules.

Various embodiments can refer to a lighting module intended to be mounted onto a rail.

BACKGROUND OF THE INVENTION

In various applicative contexts, there exists a need for lighting modules that are capable of being mounted onto a rail with the resulting possibility of making the module slide on the rail without thereby compromising the functionality and safety of the system.

For example, in the case of lighting modules using, as radiation sources, light-emitting diodes (LEDs), it is necessary to take into account the fact that by making the module slide on the rail, the useful life of the electrical contacts of the module can be significantly shortened, and, still due to the sliding, the electrical lines (tracks or wires) of the rail can be subjected to wear, thereby increasing electrical resistance.

These drawbacks can materialize particularly strongly when copper surface finishings of moderate quality are used for these components.

In many cases it is not possible to ensure that multiple contacts disconnect simultaneously and that during sliding, the electrical connection of the circuits supplying/driving the light radiation sources can break from the electrical lines of the rail; and all this has the consequence of possibly risking damaging these circuits.

SUMMARY OF THE INVENTION

One object of the present invention is to overcome, at least partly, the drawbacks outlined above.

This and other objects are attained in accordance with one aspect of the present invention directed to a lighting module for mounting onto a C-shaped rail having a bottom wall with electrical line means extending along the rail, the module comprising a light source board having a first face carrying at least one light radiation source and a second face carrying electrical contact means to supply said at least one light radiation source from said electrical line means. The light source board has opposed longitudinal edges. A channel-shaped housing is provided for the light source board, the housing having a web wall for emitting the light radiation and opposed side walls each facing one of the longitudinal edges of the light source board. A pair of opposed guide members are provided, each extending along one of the longitudinal edges of the light source board and facing a corresponding side wall of the housing. Each of said guide members and the corresponding side wall of said housing have complementary, mutually cooperating ramp-like surfaces to retain said light source board within said housing. Elastic means urge said light source board away from the web wall of the housing. The complementary ramp-like surfaces are elastically urged against each other.

Various embodiments provide for achieving one or more of the following advantages:

the possibility exists of safely moving the module along the rail, disconnecting the electrical contacts by exerting pressure on the module without needing to deactivate the electrical supply of the rail;

the useful life of the electrical contacts of the module is not affected negatively by the sliding of the module, in particular if the module is properly disconnected from the rail;

the electrical lines (track/wires) of the rail are not subjected to wear, and so there is no risk of having a localized increase in resistance of these electrical lines;

it is possible to use low-cost finishings, since it is possible in various embodiments to prevent the contacts of the module from dragging with a scraping effect against the electrical lines of the rail;

it is possible to ensure that multiple contacts disconnect simultaneously, ensuring that the circuits supplying/driving the light radiation source operate correctly.

BRIEF DESCRIPTION OF THE DRAWINGS

The invention will now be described, purely by way of non-limiting example, with reference to the accompanying drawings, in which.

DETAILED DESCRIPTION OF THE DRAWINGS

Figure 1:
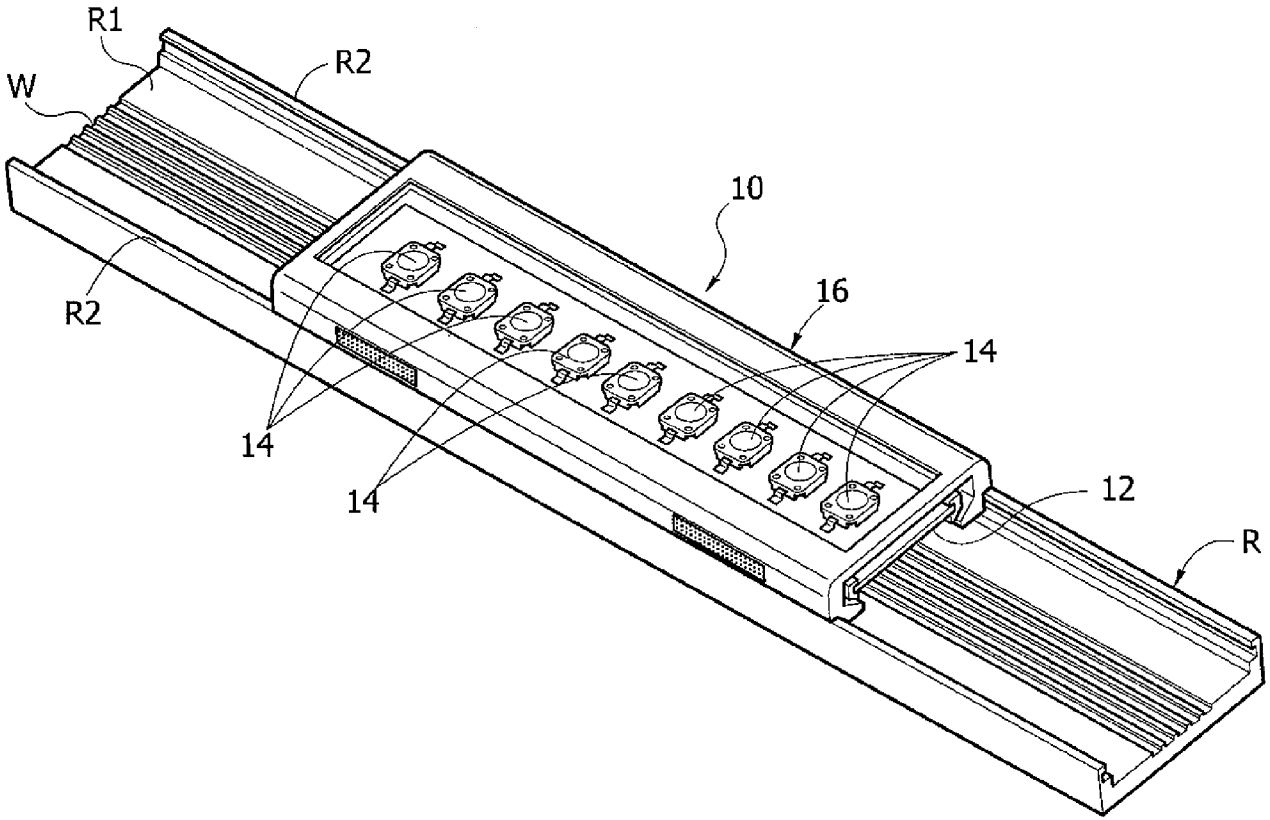
FIG. 1 is a general perspective view of an embodiment of a lighting module illustrated as being mounted on a corresponding rail.

In the following description, various specific details are illustrated aimed at an in-depth understanding of the embodiments. The embodiments can be produced without one or more of the specific details, or with other methods, components, materials, etc. In other cases, known structures, materials or operations are not shown or described in detail in order to avoid confusing the various aspects of the embodiments.

Reference to "an embodiment" in the context of this description is intended to indicate that a particular configuration, structure or characteristic described in relation to the embodiment is included in at least one embodiment. Therefore, phrases such as "in an embodiment" that may be present in different places in this description do not necessarily refer to the same embodiment. Furthermore, particular shapes, structures or characteristics can be combined in any suitable manner in one or more embodiments.

The references used here are only for convenience and do not therefore define the scope of protection or the importance of the embodiments.

In the drawings, the numerical reference 10 indicates as a whole a lighting module intended to be mounted onto a rail R.

The rail R can be for example a rail having a general C-shape with:

a bottom wall R1 in which electrical contacts W are provided in the form of tracks or wires provided in a position facing the module 10, and two side walls R2.

Rails having the characteristics described are known and are being used in present-day technology, in a wide range of different types, and they lend themselves to being produced, for example, in the form of aluminum sections or similar.

In various embodiments, the rail R (to be understood in general as a component of indefinite length) can include, for example, five electrical lines W; naturally, the number of lines in question can be different.

In various embodiments, the module 10 can include two basic components, i.e.:

a board 12 (for example in the form of a printed circuit board) carrying one or more light radiation sources formed, for example, by LEDs 14, and a housing 16 produced, for example, from plastic material or another deformable material according to criteria better described below.

In various embodiments, the board 12 can be produced in the form of a printed circuit board (PCB) provided with plated holes, according to the plated through-holes printed circuit board (PTH PCB) solution.

Figure 5:
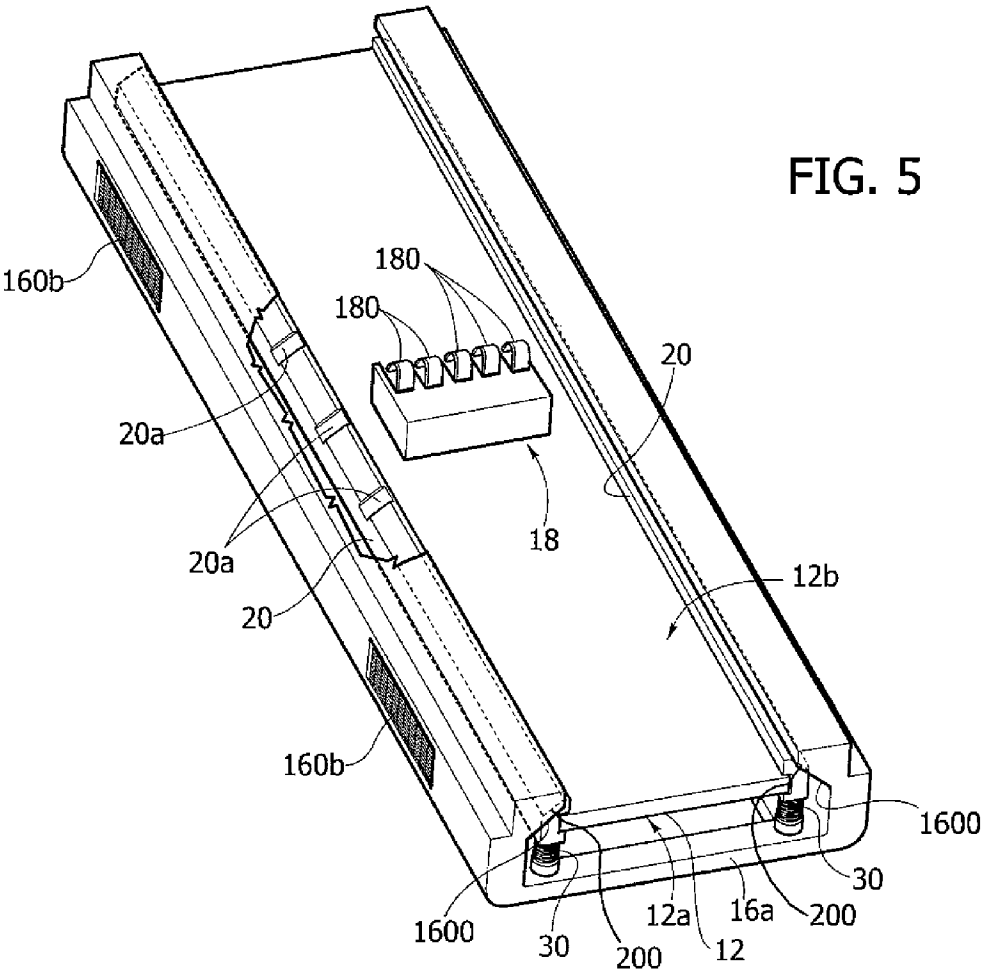
Figure 7:
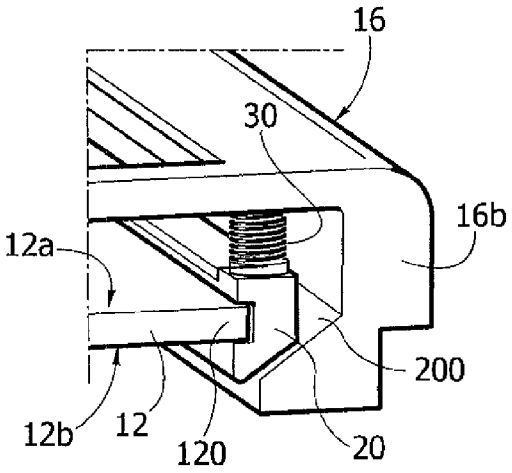

In the board 12, the following can in general be differentiated:

a first face 12*a* (facing upward in the appended drawings, with the exception of FIG. 5, in which the face 12*a* is instead facing downward), on which the light radiation sources 14 are fitted and on which the associated supply and driver circuits can also be fitted, which are not explicitly visible in the drawings, and a second face 12*b* (facing downward in the appended drawings, with the exception of FIG. 5, in which the face 12*b* is instead facing upward), carrying a structure 18 with one or more electrical contacts 180 intended to cooperate—according to a general sliding-block configuration, so as to allow the module 10 to move along the rail R—with the electrical line or lines W provided on the rail.

In various embodiments, the contact or contacts 180 of the structure 18 can have a flexing structure, being produced for example in the form of metal strips.

As part of the board 12, two longitudinal lateral edges can be distinguished, indicated by the label 120.

The housing 16 also has a channel shape which, with the module 10 mounted onto the rail R, is opposed to the C-configuration of the rail R.

In various embodiments, as part of the housing 16, a top or web wall 16*a* and two opposed side walls 16*b*, each of which faces one of the longitudinal edges 120 of the board 12, can be distinguished.

The web wall 16*a* can be produced in such a way as to allow outward propagation from the module 10 of the light radiation produced by the sources 14 which are located on the board 12.

In various embodiments, this result can be achieved, for example, by providing in the web wall 16*a* a portion of transparent material (for example providing an insert of transparent material inserted in the housing 16 at the web wall 16*a*) or simply by producing the web wall 16*a* as a windowed, i.e. open (with one or more openings), wall located at the light sources 14.

Figure 4:
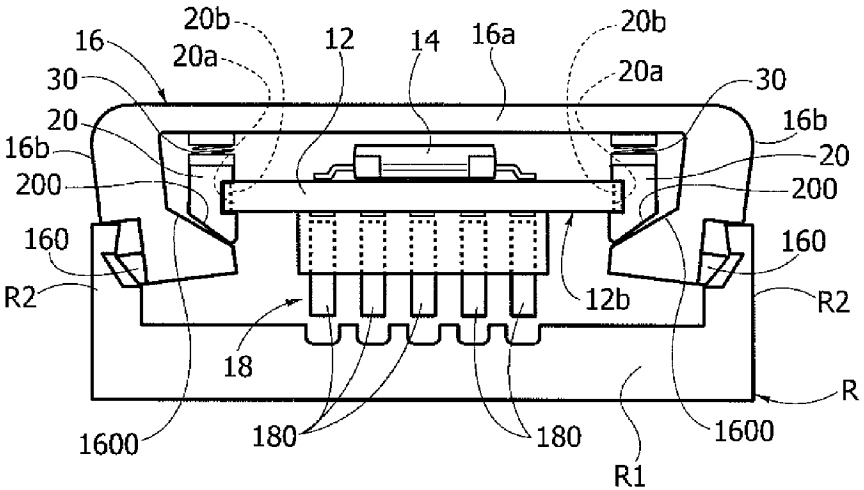

As can be better appreciated in the view of FIG. 4, in various embodiments, the side walls 16*b*, or the housing 16 as a whole, can be produced with an elastically deformable material (for example plastic material), so as to allow the coupling of the housing 16 (and of the module 10 as a whole) to the rail R according to snap-fit coupling methods.

The example embodiments to which the drawings refer provide for such a coupling to be a snap-fit coupling implemented by making sure that the side walls 16*b* of the housing 16 of the module 10 are inserted within the side walls R2 of the rail R.

In various embodiments, the coupling configuration can nevertheless be different and provide, for example, a frontal joint or a condition of coupling in which the side walls 16*b* are coupled to the side walls R of the rail on the outside of the latter.

Figure 3:
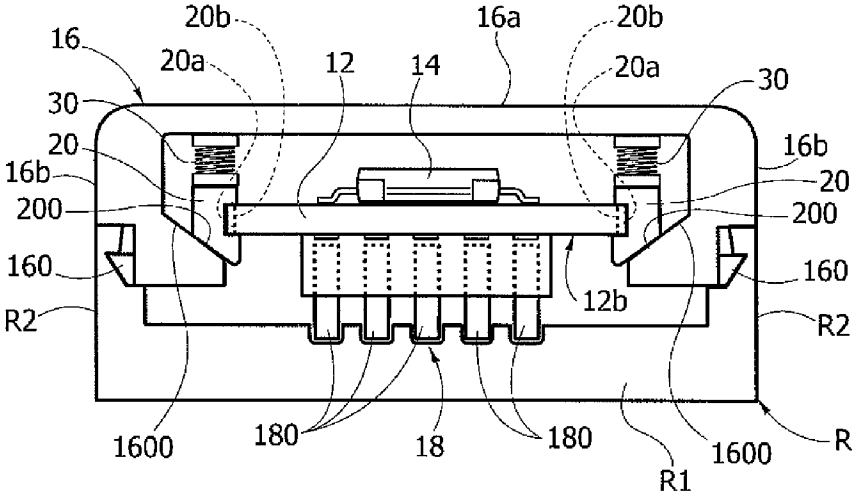
FIGS. 3 and 4 are cross-section views of FIG. 2, and FIGS. 5 to 7 illustrate various details of embodiments.

As can be appreciated, for example, in the view of FIG. 3, the example embodiments of the drawings provide that, with the module 10 coupled to the rail R, the side walls 16*b* of the housing 16 and the side walls R2 of the rail R be substantially aligned with each other, i.e. with the module 10 not projecting laterally with respect to the rail R.

In various embodiments, the side walls 16*b* of the housing can be provided with toothed formations 160 (see in particular the cross-section views of FIGS. 3 and 4) capable of clipping onto the inside of corresponding grooves made in the side walls R2 of the rail R.

In various embodiments, at the longitudinal edges 120 of the board 12, guide members. 20 can be coupled and are likely to be produced, for example, in the form of sections with a C-shape transverse profile which "embraces" the corresponding longitudinal edge 120 of the board 12.

Figure 6:
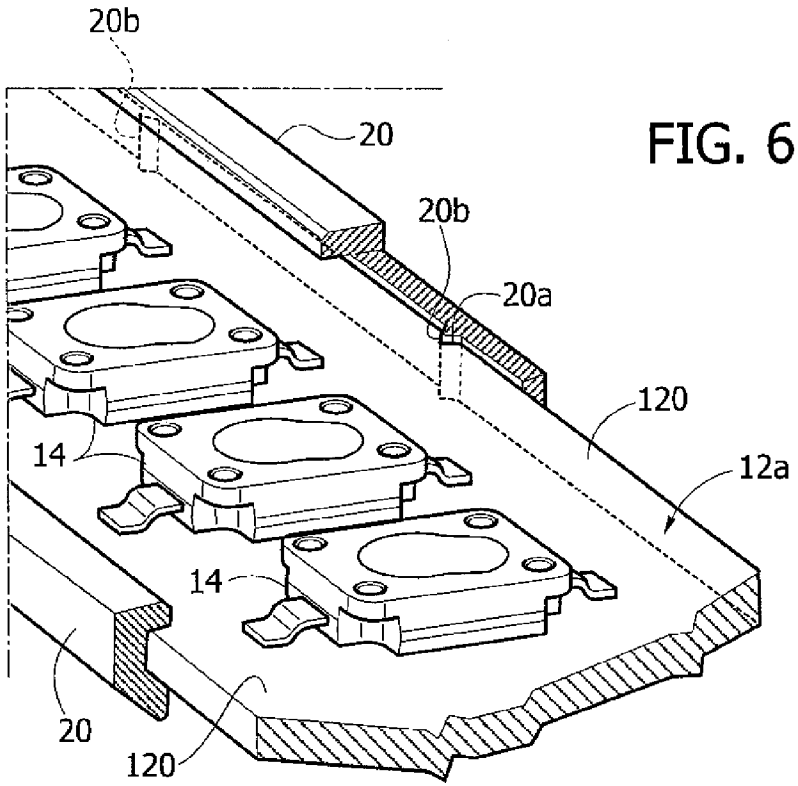

As represented in FIG. 6, the members 20 and longitudinal edges 120 of the board 12 can be provided with complementary formations, for example openings or notches 20*a* and pins 20*b* which engage in these notches so as to prevent the longitudinal sliding of the guide members 20 with respect to the edges 120.

In various embodiments, as exemplified here, provision can be made for the guide members 20 to be separate members coupled to the longitudinal edges 120 of the board 12. In various embodiments, it can nevertheless be possible to produce the guide members 20 as parts in one piece with the board 12.

Whatever the implementation choice adopted, in various embodiments, each guide member 20 is extended along one of the longitudinal edges 120 of the board 12 in a position facing a corresponding side wall 16*b* of the housing 16.

In various embodiments, the guide members 20 and the side walls 16*b* can be provided with mutually cooperating ramp-like surfaces, indicated by the labels 200 and 1600 respectively, which produce a sort of wedge coupling between, on the one hand, the board 12, with the guide members 20 coupled to it, or produced in one piece with it, for example with the surfaces 200 forming lateral chamfering of the board 12 and, on the other hand, the housing 16.

In particular, the ramp-like surfaces 200 and 1600 (likely, in various embodiments, to be produced as flat surfaces), can define, in various embodiments: each surface 200, a surface of the respective guide member 120 facing outward and in the opposite direction to the board 12, and each surface 1600, a surface of the corresponding side wall 16*b* facing toward the inside of the housing 16, toward the board 12.

The numerical references 30 indicate elastic elements, capable of being produced, for example, in the form of helical springs 30 worn, for example, on corresponding centering pins projecting from the web wall 16*a* of the housing 16. In various embodiments, these elastic elements can be intended to act between the housing 16 and the guide members 20 (therefore in general between the housing 16 and the board 12) in the sense of urging the board 12 away from the web wall 16*a*, therefore in a condition such that the ramp-like surfaces 200 and 1600 are forced into a condition of contact with each other.

The wedge coupling that is elastically (pre-)charged by the elastic elements (springs) 30 ensures that, from an undeformed condition, represented in FIG. 3, the housing 16 can be laterally compressed (making it contract), for example by acting on portions of the outer surface of the side walls 16*b* made rough on the surface (see the labels 160*b* in FIG. 2), as is schematically represented in FIG. 4.

The effect of the cooperation of the surfaces 200 and 1600 and their orientation ensures that this contraction (capable of being derived from the elastic deformability of the walls 16*b* and/or of the housing 16 as a whole), in addition to allowing the disengaging of the side walls 16*b* of the housing 16 from the side walls R2 of the rail R, also determines a pulling of the board 12 close to the web wall 16*a* against the force of the elastic elements (springs) 30, with a resulting removal of the contact structure 18 from the bottom wall R1 of the rail so as to disconnect (separate) the contacts 180 from the electrical lines W provided on this bottom wall.

Figure 2:
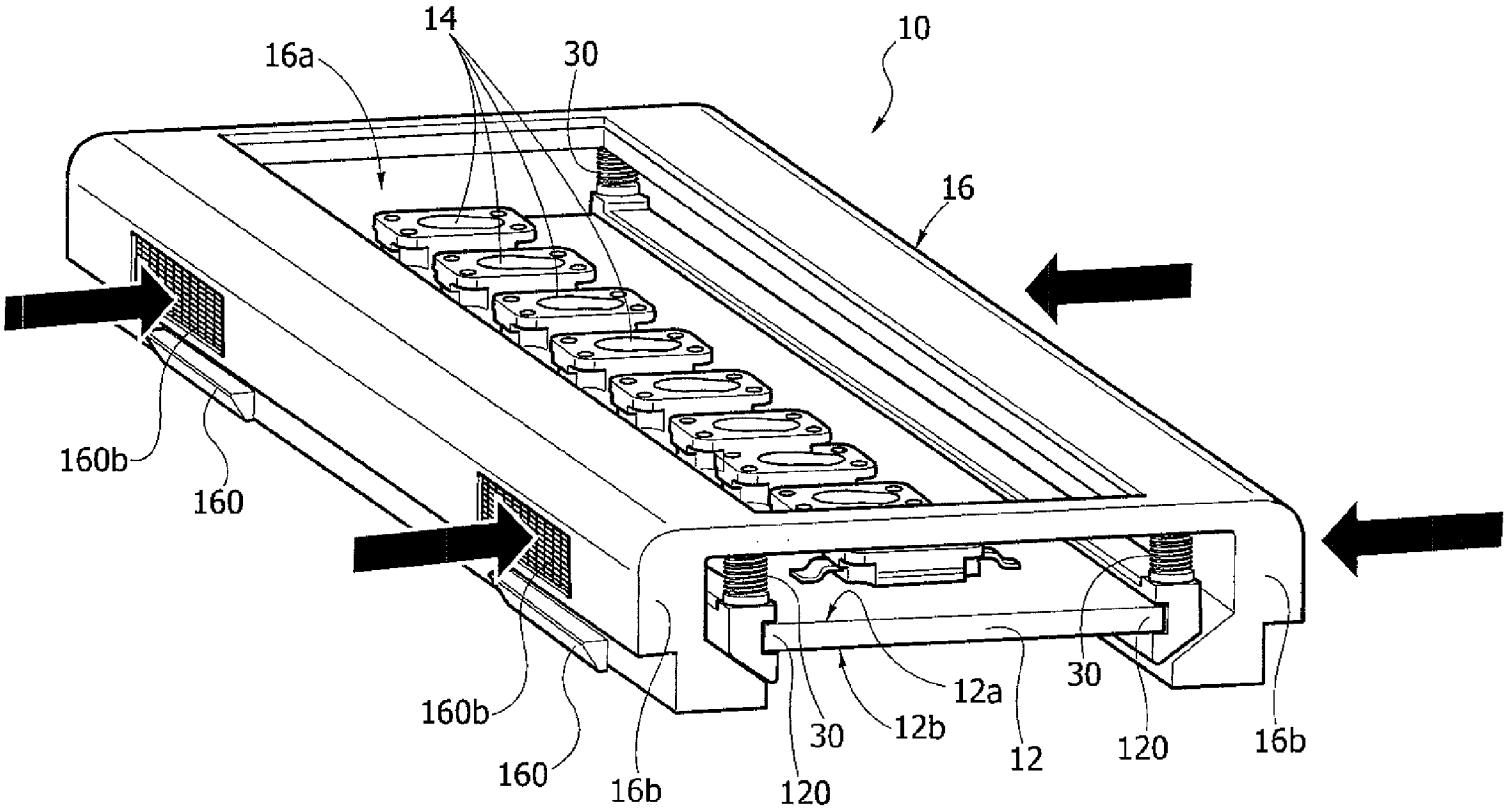
FIG. 2 illustrates an embodiment of a module, reproduced in slightly enlarged scale.

By deforming the housing 16 as represented schematically in FIG. 2, the module 10 can be coupled to the rail R so as to couple the side walls 16*b* of the housing with the side walls R2 of the rail. By releasing the contraction force applied previously (as indicated schematically by the side-pointing arrows in FIG. 4), the housing 16 assumes the undeformed condition represented in FIG. 3, in which the side walls 16*b* of the housing 16 are coupled with the side walls R2 of the rail R, with the toothed formations 160 (where present) which engage the abovementioned side walls R2 and with the elastic elements 30 which urge the board 12 away from the web wall 16*a* keeping the contacts 180 of the structure 18 in electrical contact with the lines W provided in the bottom wall R1 of the rail R.

The module 10 thus coupled to the rail R can be made to slide along the same rail by exerting on the walls 16*b* a light lateral compression so as to make the coupling with the side walls R2 of the rail less tight.

The ramp-like shaping of the surfaces 200 and 1600 also determines as a result the moving-away of the board 12 from the bottom wall R1 of the rail and the moving-away of the contacts 180 from the lines W, preventing, when the module 10 is sliding along the rail R, the contacts 180 from dragging against the lines W with a consequent risk of wear.

By instead exerting a more complete lateral contraction action on the housing 16 (as precisely represented in FIG. 4), it is possible to achieve the complete disengaging of the side walls 16*b* of the housing 16 from the side walls R2 of the rail R so as to be able to remove the module 10 from the rail R.

Also in this case, the lateral contraction of the housing has the effect of moving the contacts 180 away from the line W breaking the electrical contact, likely to be restored only when returned to the undeformed condition of FIG. 3. This allows the module 10 to be easily removed from or inserted into the rail R without needing to deactivate the electrical supply of the rail.

FIG. 5, corresponding to an ideal view "from beneath" of the module 10, highlights the possible presence, for example on the surface 200, of formations so as to prevent the lateral sliding of the parts involved (surfaces 200 and 1600), in such a way as to ensure that the movement of the board 12 relative to the housing 16 takes place only in the direction of the board 12 moving closer to and away from the web wall 16*a*. This can facilitate the execution of the self-centering function of the board 12 relative to the housing 16, carried out by the ramp-like walls 200 and 1600.

Naturally, the principle of the invention remaining the same, the details of construction and forms of embodiment may be varied, even significantly, with respect to those illustrated here purely by way of non-limiting example, without thereby departing from the scope of protection of the invention, this scope of protection of the invention being defined by the appended claims.

The invention claimed is:

1. A lighting module for mounting onto a c-shaped rail having a bottom wall with electrical line means that extends along the rail for supplying electric power to the lighting module, the lighting module comprising:

a light source board having a first face carrying at least one light radiation source and a second face carrying electrical contact means for relaying to said at least one light radiation source the electric power from said electrical line means, said light source board having a pair of opposed longitudinal edges;

a channel-shaped housing for said light source board, said housing having a web wall for emitting said light radiation and a pair of opposed side walls each facing one of said opposed longitudinal edges of said light source board;

a pair of opposed guide members, each extending along one of said opposed longitudinal edges of said light source board and facing a corresponding side wall of said housing, wherein each of said opposed guide members and said corresponding side wall of said housing have complementary, mutually cooperating ramp-like surfaces to retain said light source board within said housing; and elastic means for urging said light source board away from said web wall of said housing, wherein said complementary, mutually cooperating ramp-like surfaces are elastically urged against each other.

2. The lighting module according to claim 1, wherein said complementary, mutually cooperating ramp-like surfaces include:

a surface of each of said opposed guide members facing outwardly and away from said light source board; and a surface in said corresponding side wall of said housing facing an interior of said housing and toward said light source board.

3. The lighting module according to claim 1, wherein said complementary, mutually cooperating ramp-like surfaces are flat surfaces.

4. The lighting module according to claim 1, wherein said elastic means includes springs acting between said web wall of said housing and said opposed guide members.

5. The lighting module according to claim 1, wherein said opposed guide members have C-shaped sections, each of said C-shaped sections embracing one of said opposed longitudinal edges of said light source board.

6. The lighting module according to claim 1, wherein said opposed guide members and said opposed longitudinal edges of said light source board have mutually cooperating formations to prevent a sliding of said guide opposed members relative to said light source board.

7. The lighting module according to claim 1, wherein said side walls of said housing have toothed formations to engage said rail.

8. The lighting module according to claim 1, wherein said side walls of said housing are elastically resilient to mount/remove the lighting module with respect to said rail, and wherein elastic deformation of said side walls determines, due to presence of said complementary, mutually cooperating ramp-like surfaces, a movement of said light source board with respect to said web wall of said housing.

9. The lighting module according to claim 1, wherein said at least one light radiation source includes an LED.

* * * * *